US012696929B2

(12) United States Patent
Bachmann

(10) Patent No.: US 12,696,929 B2
(45) Date of Patent: Aug. 4, 2026

(54) STRUCTURED FILTER MATERIAL FOR NICOTINE DELIVERY PRODUCTS

(71) Applicant: DELFORTGROUP AG, Traun (AT)

(72) Inventor: Stefan Bachmann, Fulpmes (AT)

(73) Assignee: DELFORTGROUP AG, Traun (AT)

( * ) Notice: Subject to any disclaimer, the term of this patent is extended or adjusted under 35 U.S.C. 154(b) by 325 days.

(21) Appl. No.: 18/276,909

(22) PCT Filed: Feb. 15, 2022

(86) PCT No.: PCT/EP2022/053672

§ 371 (c)(1),
(2) Date: Aug. 11, 2023

(87) PCT Pub. No.: WO2022/175261

PCT Pub. Date: Aug. 25, 2022

(65) Prior Publication Data

US 2024/0114951 A1 Apr. 11, 2024

(30) Foreign Application Priority Data

Feb. 19, 2021 (DE) ..... 10 2021 104 011.6

(51) Int. Cl.
*A24D 3/02* (2006.01)
*A24B 13/00* (2006.01)
(Continued)

(52) U.S. Cl.
CPC ..... *A24D 3/0275* (2013.01); *A24B 13/00* (2013.01); *A24D 1/045* (2013.01); *A24D 3/0204* (2013.01);
(Continued)

(58) Field of Classification Search
CPC ..... A24D 3/0275; A24D 3/17
See application file for complete search history.

(56) References Cited

U.S. PATENT DOCUMENTS 3,202,155 A 8/1965 Caines et al.
4,125,061 A 11/1978 Goavec
(Continued)

FOREIGN PATENT DOCUMENTS

CN 102821625 A 12/2012
CN 110558609 A 12/2019
(Continued)

OTHER PUBLICATIONS

International Search Report and Written Opinion in Application No. PCT/EP2022/053672 dated Jun. 7, 2022 (16 pages) [German language only].
(Continued)

*Primary Examiner* — Russell E Sparks
(74) *Attorney, Agent, or Firm* — Barclay Damon LLP

(57) ABSTRACT

A filter material is described for manufacturing a nicotine delivery product, wherein the filter material is hydroentangled and contains at least 50% and at most 100% cellulose fibers, each with respect to the mass of the filter material, wherein the filter material has a basis weight of at least 25 g/m$^2$ and at most 60 g/m$^2$, and wherein the filter material has a structure that is characterized in that it provides the filter material with a transparency that, measured in accordance with DIN 53147:1993-01, is at least 45% and at most 70%. Furthermore, a segment comprising a filter material for a nicotine delivery product, a smoking article which comprises such a segment, an oral nicotine delivery product, and a process for the manufacture of the filter material are described.

33 Claims, 1 Drawing Sheet

(51) Int. Cl.

| | |
|---|---|
| ***A24D 1/04*** | (2006.01) |
| ***A24D 3/04*** | (2006.01) |
| ***A24D 3/06*** | (2006.01) |
| ***A24D 3/10*** | (2006.01) |
| ***A24D 3/14*** | (2006.01) |
| ***A24D 3/17*** | (2020.01) |
| ***D04H 1/26*** | (2012.01) |
| ***D04H 1/4258*** | (2012.01) |
| ***D04H 1/492*** | (2012.01) |
| ***D04H 1/732*** | (2012.01) |

(52) U.S. Cl.

CPC ..... *A24D 3/04* (2013.01); *A24D 3/062* (2013.01); *A24D 3/067* (2013.01); *A24D 3/10* (2013.01); *A24D 3/14* (2013.01); *A24D 3/17* (2020.01); *D04H 1/26* (2013.01); *D04H 1/4258* (2013.01); *D04H 1/492* (2013.01); *D04H 1/732* (2013.01); *D10B 2505/04* (2013.01)

(56) References Cited

U.S. PATENT DOCUMENTS

| | | | | |
|---|---|---|---|---|
| 4,488,563 | A | 12/1984 | Morifuji et al. | |
| 5,738,119 | A | 4/1998 | Edwards, III et al. | |
| 5,839,448 | A * | 11/1998 | Woodings | D04H 1/492 131/334 |
| 8,393,334 | B2 * | 3/2013 | Cecchetto | A24D 1/02 131/346 |
| 8,469,038 | B2 * | 6/2013 | Sinclair, Jr. | A24C 3/00 131/365 |
| 10,513,826 | B2 | 12/2019 | Latendorf et al. | |
| 11,083,217 | B2 | 8/2021 | Bachmann et al. | |
| 11,214,901 | B2 | 1/2022 | Kellner et al. | |
| 2004/0129632 | A1 | 7/2004 | Le Brech et al. | |
| 2008/0295852 | A1 | 12/2008 | Riepert et al. | |
| 2009/0324926 | A1 | 12/2009 | Luo | |
| 2010/0272938 | A1 | 10/2010 | Mitchell et al. | |
| 2014/0096783 | A1 | 4/2014 | Sebastian et al. | |
| 2015/0001148 | A1 | 1/2015 | Pan et al. | |
| 2015/0059789 | A1 | 3/2015 | Mccormack et al. | |
| 2015/0374030 | A1 | 12/2015 | Lisauskas et al. | |
| 2017/0245542 | A1 | 8/2017 | Zappoli | |
| 2019/0289903 | A1 | 9/2019 | Poget et al. | |
| 2020/0397040 | A1 | 12/2020 | Kitaoka | |
| 2021/0164138 | A1 | 6/2021 | Gregorich et al. | |

FOREIGN PATENT DOCUMENTS

| | | | |
|---|---|---|---|
| CN | 110616505 | A | 12/2019 |
| DE | 1295453 | B | 5/1969 |
| DE | 102005017478 | A1 | 10/2006 |
| EP | 2228209 | A1 | 9/2010 |
| EP | 2515689 | B1 | 2/2014 |
| EP | 2985375 | A1 | 2/2016 |
| EP | 3385425 | A1 | 10/2018 |
| EP | 3715515 | A1 | 9/2020 |
| FR | 2314679 | A | 1/1977 |
| GB | 2309466 | A | 7/1997 |
| WO | 1991017297 | A1 | 11/1991 |
| WO | 1995014398 | A1 | 6/1995 |
| WO | 1995035044 | A1 | 12/1995 |
| WO | 2013112502 | A1 | 8/2013 |
| WO | 2014009498 | A1 | 1/2014 |
| WO | 2015178995 | A1 | 11/2015 |
| WO | 2016120014 | A1 | 8/2016 |
| WO | 2017162347 | A1 | 9/2017 |
| WO | 2018184925 | A1 | 10/2018 |
| WO | 2020025440 | A1 | 2/2020 |
| WO | 2020115219 | A1 | 6/2020 |
| WO | 2021115619 | A1 | 6/2021 |
| WO | 2022018180 | A1 | 1/2022 |
| WO | 2022262955 | A1 | 12/2022 |
| WO | 2022263029 | A1 | 12/2022 |
| WO | 2022263030 | A1 | 12/2022 |

OTHER PUBLICATIONS

"HydroFormer and AquaJet: A powerful team for wet-laid spunlaced nonwovens," Voith Paper Holding GmbH & Co KG [E7/E7a—English and German-language versions], (2015), 13 pages.

Additional information on the publication of the Voith brochure: 'For wet-laid and water-jet-bonded nonwovens—HydroFormer and AquaJet', [E7b—English and German-language versions] <URL:https://web.archive.org/web/20191101000000*/https://voith.com/corp-de/productsservices/papermaking-components/hydroformer.html> (2019-2020), 6 pages.

Affidavit of Thomas Weigert (Jun. 2, 2023) [E8a—English and German-language versions], 2 pages.

Program of the 29th Hof Nonwovens Days 2014, Wednesday Program [E8b—German-language version] (Nov. 5, 2014), 2 pages.

Participant List for 29th Hof Nonwovens Days 2014, Nov. 5 & 6, 2014, [E8c] 9 pages.

Weigert & Pöhler, "Wetlaid, Spunlaced Nonwovens. One step beyond Flushable Wipes," [E8] Slide Presentation from 29th Hof Nonwoven Days 2014, Trutzschler Nonwovens / VOITH (2014), 37 pages.

Affidavit of Thomas Weigert (Jun. 2, 2023) [E9a—English and German-language versions], 2 pages.

Program of the 24th International Munich Paper Symposium: Progress in paper and board production, Mar. 11-13, 2015 [E9b—English and German-language versions], 6 pages.

Participant List for 24th International Munich Paper Symposium, Mar. 11-13, 2015, [E9c] 3 pages.

Weigert & Pöhler, "Paper and Nonwoven Webforming with Wet-laid Spunlace (WLS)," Trutzschler Nonwovens / VOITH, Slides from 24th International Munich Paper Symposium (IMPS), (2015), [E9] 17 pages.

"Filtration," Sect. 14.2, Excerpt from Ch. 14 of Vliesstoffe: Rohstoffe Herstellung Anwendung / Nonwovens: Raw Materials, Manufacture, Application, Properties and Testing, 2nd ed. [E10—English and German-language versions], Wiley-VCH Verlag & Co. KGaA (pub.), Weinheim, Germany, pp. 572-573, (2012), 6 pages.

International Search Report and Written Opinion (with English translation of ISR) in Application No. PCT/EP2019/085125, dated May 29, 2020, 10 pages.

International Preliminary Report on Patentability in Application No. PCT/EP2019/085125 dated May 17, 2022 (with English translation), 10 pages.

International Search Report and Written Opinion (with English translation of ISR) in Application No. PCT/EP2021/070473, dated Nov. 12, 2021, 13 pages.

International Preliminary Report on Patentability in Application No. PCT/EP2021/070473 dated Jan. 24, 2023 (with English translation), 13 pages.

International Preliminary Report on Patentability in Application No. PCT/EP2022/053672 dated Aug. 22, 2023 (with English translation), 12 pages.

International Search Report and Written Opinion in Application No. PCT/EP2022/057374 dated Oct. 12, 2022 (with English translation of ISR), 27 pages.

International Preliminary Report on Patentability in Application No. PCT/EP2022/057374 dated Dec. 14, 2023 (English translation), 10 pages.

International Search Report and Written Opinion in Application No. PCT/EP2021/066102 dated Mar. 16, 2022 (with English translation of ISR), 21 pages.

International Preliminary Report on Patentability in Application No. PCT/EP2021/066102 dated Dec. 14, 2023, 10 pages.

International Search Report and Written Opinion in Application No. PCT/EP2022/057367 dated Jul. 19, 2022 (with English translation of ISR), 21 pages.

(56) References Cited

OTHER PUBLICATIONS

International Preliminary Report on Patentability in Application No. PCT/EP2022/057367 dated Dec. 14, 2023 (English translation), 7 pages.
China State Intellectual Property Office, Notice of First Examination Opinion, Application No. 202180099172.7, dated Apr. 13, 2026, 18 pages.
Korean Intellectual Property Office, Notice of Preliminary Rejection, Application No. 10-2023-7001831, dated May 4, 2026, 12 pages.

* cited by examiner

STRUCTURED FILTER MATERIAL FOR NICOTINE DELIVERY PRODUCTS

CROSS-REFERENCE TO RELATED APPLICATIONS

This application is the national phase entry of International Patent Application No. PCT/EP2022/053672, filed Feb. 15, 2022, and claims the benefit of German Patent Application No. 10 2021 104 011.6, filed Feb. 19, 2021, the disclosures of which are incorporated herein by reference in their entirety.

FIELD OF THE INVENTION

The invention relates to a filter material for a nicotine delivery product, a segment for a smoking article manufactured therefrom or an oral nicotine delivery product manufactured therefrom, wherein the filter material has a structure that provides advantageous properties to a nicotine delivery product, for example with respect to hardness, draw resistance, filtration efficiency, optical appearance or biodegradability. The structure of the filter material is thereby characterized by its transparency.

BACKGROUND AND PRIOR ART

Nicotine delivery products can be smoking articles. Smoking articles are typically rod-shaped articles, that consist of at least two rod-shaped segments arranged next to each other. A segment contains a material that is capable of forming an aerosol upon heating, and at least one further segment contains a material that serves to influence the properties of the aerosol.

The smoking article can be a filter cigarette, wherein a first segment contains the aerosol-forming material, in particular tobacco, and a further segment that is formed as a filter and serves for the filtration of the aerosol. The aerosol is generated here by burning the aerosol-forming material, and the filter serves to filter the aerosol and provide a defined draw resistance to the filter cigarette.

The smoking article can also be a so-called heated tobacco product, wherein the aerosol-forming material is only heated but not burned. The number and amount of harmful substances in the aerosol are reduced thereby. Such a smoking article also consists of at least two segments, but often more, in particular, four. A segment contains the aerosol-forming material, which typically comprises tobacco, reconstituted tobacco, tobacco treated by other processes or nicotine and glycerol or propylene glycol. Further, in some instances, optional segments in the heated tobacco product serve to transfer the aerosol, to cool the aerosol or to filter the aerosol.

The segments are usually wrapped with a wrapping material. Very often, paper is used as the wrapping material.

In what follows, unless explicitly indicated otherwise or directly derivable from the context, the term "segment" should be understood to be the segment of a smoking article that does not contain the aerosol-forming material but, for example, serves to transfer, cool or filter the aerosol.

In the prior art, it is known to form such segments from cellulose acetate or polylactides. Because cellulose acetate and polylactides biodegrade only very slowly in the environment, the industry has an interest in manufacturing the segments of smoking articles from other materials which biodegrade better. In the prior art, it is known to manufacture segments for smoking articles, in particular filter segments, from paper. Such segments in general biodegrade well, but suffer from some disadvantages. As an example, filter segments produced from paper generally have a high filtration efficiency and therefore result in a dry aerosol, which compromises the taste of the aerosol compared with cigarettes with the conventional filter segments produced from cellulose acetate. Furthermore, they often have a lower filtration efficiency for phenols than cellulose acetate. In addition, it has been shown to be difficult to manufacture a segment from paper that is acceptable for the consumer with respect to the combination of draw resistance, filtration efficiency and hardness. In order to reduce the filtration efficiency, less paper is often used, and the segment becomes soft and has a low draw resistance.

A further reason why filter segments from paper have not yet found widespread use, however, lies in their optical appearance. At the mouth end of the smoking article, the cut face of the segment located at the mouth end is often visible, and with conventional segments produced from cellulose acetate, the consumer is used to a homogeneous white surface, in which individual cut fibers are barely recognizable. Segments from paper, however, have a coarse structure, which apparently communicates an impression of lower quality to the consumer. Thus, segments from paper are often only used as one segment in a filter composed of several segments, so that the consumer cannot see the cut face. Therefore, the segment located at the mouth end is still frequently produced from cellulose acetate. Because of these optical defects, the advantages of biodegradability of a segment from paper cannot be fully utilized.

The nicotine delivery product can also be an oral nicotine delivery product. Oral nicotine delivery products are typically small pouches formed by a nonwoven that contains a nicotine-containing material, for example, tobacco. During use, the consumer stores the pouch in their mouth for some time, whereupon substances, in particular nicotine, can be released from the nicotine-containing material. The nonwovens forming the pouch, however, mostly contain plastics, and therefore are not biodegradable. Examples of oral nicotine delivery products are products packed in pouches, like Swedish snus, white snus or other smoke-free tobacco products. Oral nicotine delivery products without tobacco are also known.

Thus, there is an interest in the industry to have available a filter material that allows segments to be manufactured for smoking articles that have an advantageous combination of filtration efficiency, draw resistance, hardness and optical appearance, or that allow nicotine delivery products with good biodegradability to be manufactured.

SUMMARY OF THE INVENTION

The objective of the invention is to provide a filter material for a smoking article which enables segments to be manufactured that are as similar as possible to conventional segments produced from cellulose acetate in respect of hardness, draw resistance, filtration efficiency and optical appearance, but which also biodegrade well.

A further objective of the invention is to provide a filter material from which oral nicotine delivery products can be manufactured, and which have better biodegradability.

These objectives are achieved by means of a filter material according to claim 1, a process for manufacturing the filter material according to claim 27, a segment of a smoking article according to claim 15, a smoking article according to claim 21 and an oral nicotine delivery product according to claim 26. Advantageous embodiments are defined in the dependent claims.

The inventors have found that these objectives can be achieved by a filter material, wherein the filter material is hydroentangled and contains at least 50% and at most 100% cellulose fibers, each with respect to the mass of the filter material, and wherein the filter material has a basis weight of at least 25 g/m$^2$ and at most 60 g/m$^2$, and wherein the filter material has a structure that is characterized in that it provides a transparency to the filter material that, measured in accordance with DIN 53147:1993-01, is at least 45% and at most 70%.

According to the invention, the filter material is manufactured by hydroentangling. This manufacturing process provides characteristic properties to the filter material that differentiate it from other filter materials, and in particular from papers, and which cannot be obtained in identical manner by other manufacturing processes. In contrast to paper, for example, wherein the strength is primarily due to hydrogen bonds and the fibers are mainly arranged in the plane of the paper, the strength of the hydroentangled nonwoven is achieved by entanglement of the fibers, and thus a substantial proportion of the fibers is also oriented in the thickness direction of the nonwoven. This arrangement of the fibers is, inter alia, essential so that a segment manufactured therefrom has advantageous properties with respect to draw resistance, filtration efficiency and hardness.

The inventors have found that segments produced from hydroentangled filter materials according to the composition according to the invention in general have better properties than segments manufactured from paper, but there is still potential to further optimize these properties and bring them even closer to segments from cellulose acetate. In similar manner to segments produced from paper, but to a lesser extent, a problem arises because for good filtration efficiency, only a little filter material may be used, and thus the draw resistance and in particular the hardness of the segment cannot completely satisfy the consumer's expectations. According to the findings of the inventors, a special structure of the filter material can solve this problem. The inventors have recognized that it is advantageous for the filter material not to have an approximately homogeneous surface like a sheet of paper or a plastic film, but rather to have a plurality of irregularities with respect to thickness or the basis weight distributed over the entire surface. These irregularities may, for example, be holes or thinner spots that are regularly or irregularly arranged on the filter material. In this regard, according to the findings of the inventors, it is advantageous for the holes or thinner spots not to be produced by removing material, but rather to be entirely or partially produced by a re-distribution and change in the arrangement of the fibers in the filter material. This can be achieved by a manufacturing process according to the invention as explained below.

In this regard, the precise shape and arrangement of the irregularities is not important, but they have to be approximately uniformly distributed over the surface and must exceed a certain size. In order to characterize these irregularities and in particular their size, the inventors have considered various parameters such as, for example, the thickness, the basis weight or the air permeability. It was found, however, that these parameters cannot be measured in a sufficiently low spatial resolution to capture the irregularities.

The inventors have, however, recognized that the transparency of the filter material is changed by the re-distribution of the fibers. In other words, the special structure that distinguishes the filter material according to the invention provides the filter material with a characteristic, higher transparency, by which the filter material is differentiated from filter materials of the same basis weight and similar composition but conventional structure. In this respect, the transparency is a suitable, unambiguously measurable parameter that can be used for the characterization of the desired structure of the filter material.

The observed increase in transparency for filter materials with the desired structure is surprising in this regard, because a re-distribution of the fibers would indeed be expected to make the holes or thin spots more transparent, but the regions between the holes and thin spots, in which more fibers would then be present, would become less transparent so that in total, on average, there would be little or no effect on the transparency. In fact, however, the experiments show that filter materials with a conventional structure, even at the lowest basis weight according to the invention of 25 g/m$^2$, have a transparency in accordance with DIN 53147:1993-01 that does not exceed a value of 40%. Only the re-distribution of fibers can achieve a higher transparency, and this is in a direct relationship to the holes and thin spots originating from the re-distribution of the fibers, i.e. of the structure of the filter material; this also brings the advantages according to the invention with respect to hardness and draw resistance of a segment manufactured therefrom.

According to the findings of the inventors, the cellulose fibers are necessary in order to provide the filter material with sufficient strength, so that it can be processed into a segment. According to the invention, the proportion of cellulose fibers in the filter material is at least 50% and at most 100% of the mass of the filter material, preferably, however, at least 60% and at most 100%, and particularly preferably at least 70% and at most 95%, each with respect to the mass of the filter material.

The cellulose fibers can be pulp fibers or fibers from regenerated cellulose or mixtures thereof.

The pulp fibers are preferably sourced from coniferous wood, deciduous wood or other plants such as hemp, flax, jute, ramie, kenaf, kapok, coconut, abacá, sisal, bamboo, cotton, or esparto grass. In addition, mixtures of pulp fibers from various origins can be used for the manufacture of the hydroentangled filter material. Particularly preferably, the pulp fibers are sourced from coniferous wood, because even in smaller proportions, such fibers provide the filter material with good strength.

The filter material according to the invention can contain fibers from regenerated cellulose. Preferably, the proportion of fibers from regenerated cellulose is at least 5% and at most 50%, particularly preferably at least 10% and at most 45% and in particular at least 15% and at most 40%, each with respect to the mass of the filter material.

The fibers from regenerated cellulose are preferably viscose fibers, Modal fibers, LYOCELL® (cellulose fiber made from wood pulp), TENCELI® (cellulose fiber made from wood pulp) or mixtures thereof. These fibers have good biodegradability and can be used to optimize the strength of the filter material and to adjust the filtration efficiency of a segment manufactured therefrom to the smoking article. Because of their production process, they are less variable than pulp fibers sourced from natural sources and therefore contribute to a lower variability of the properties of a segment manufactured from the filter material than if pulp fibers were to be used exclusively.

According to the invention, the basis weight of the filter material is at least 25 g/m$^2$ and at most 60 g/m$^2$, preferably at least 28 g/m$^2$ and at most 55 g/m$^2$ and particularly preferably at least 30 g/m$^2$ and at most 55 g/m$^2$. The basis weight influences the tensile strength of the filter material, wherein a higher basis weight can lead to a higher strength. The values relate to a basis weight measured in accordance with ISO 536:2012.

According to the invention, the transparency of the filter material measured in accordance with DIN 53147:1993-01 is at least 45% and at most 70%, preferably at least 50% and at most 66%. Beyond a transparency caused by the redistribution of the fibers of at least 45%, positive effects with respect to hardness and draw resistance of a segment manufactured from the filter material are exhibited. The transparency should not be too high, however, because then the thin spots and holes predominate to such an extent that the strength of the filter material is no longer suitable for manufacturing segments therefrom.

In fact, the shape and size of the irregularities cannot be specified precisely, as they cannot be accurately delimited from the surrounding filter material; clearly, however, each individual irregularity has to be much smaller than the area of the filter material required for the manufacture of a segment. Because the special structure of the filter material is also formed by holes, the area of a majority of the holes, for example, of more than 90% of the holes, is preferably less than 10 mm$^2$. At these scales, the transparency is particularly suitable as the parameter characterizing the structure of the filter material, because the measurement area for the measurement of the transparency in accordance with DIN 53147:1993-01 is about 2.5 cm$^2$ and thus in general, representatively includes holes or thin spots as well as the surrounding regions. Embodiments that illustrate these irregularities are shown in FIG. 2 by way of example and are explained below. However, the invention is not limited to irregularities with the geometry shown in FIG. 2.

For the adjustment of specific properties, the filter material according to the invention can contain additives such as alkyl ketene dimers (AKD), alkenyl succinic acid anhydrides (ASA), fatty acids, starch, starch derivatives, carboxy methyl cellulose, alginates, wet strength agents or substances for the adjustment of the pH, such as, for example, organic or inorganic acids or bases. As additives, the filter material according to the invention can also contain one or more burn additives that are selected from the group consisting of citrates, malates, tartrates, acetates, nitrates, succinates, fumarates, gluconates, glycolates, lactates, oxalates, salicylates, α-hydroxy caprylates, phosphates, polyphosphates, chlorides and hydrogen carbonates and mixtures thereof and particularly preferably from the group consisting of trisodium citrate, tripotassium citrate and mixtures thereof.

The skilled person will be able to determine the type and amount of such additives from his experience.

The filter material according to the invention can also contain other substances that bring the filtration efficiency of the filter material into better line with that of cellulose acetate. In a preferred embodiment of the filter material according to the invention, the filter material comprises a substance selected from the group consisting of triacetin, propylene glycol, sorbitol, glycerol, polyethylene glycol, polypropylene glycol, polyvinyl alcohol and triethyl citrate, or mixtures thereof.

The thickness of the filter material, measured in accordance with ISO 534:2011, is at least 70 μm and at most 1000 μm, preferably at least 100 μm and at most 800 μm and particularly preferably at least 150 μm and at most 750 μm. The thickness influences the amount of filter material that can be packed into the segment of the smoking article and therefore influences the draw resistance and the filtration efficiency of the segment, and also the processability of the filter material, as it is often crimped or folded for the manufacture of a segment for a smoking article. For such process steps, too great a thickness is disadvantageous and thicknesses in the preferred and particularly preferred intervals enable particularly good processability of the filter material according to the invention to be obtained in order to form a segment of a smoking article.

The mechanical properties of the filter material are important for processing the filter material according to the invention into a nicotine delivery product. In particular, the holes or thin spots should not reduce the strength of the filter material too much. The tensile strength with respect to the width of the filter material, measured in accordance with ISO 1924-2:2008, is preferably at least 0.05 kN/m and at most 5 kN/m, particularly preferably at least 0.07 kN/m and at most 4 kN/m.

The elongation at break of the filter material is important because, during processing of the filter material according to the invention into a nicotine delivery product, the filter material is often stretched or stressed in the running direction, and therefore a particularly high elongation at break is beneficial; The elongation at break of the filter material, measured in accordance with ISO 1924-2:2008, is thus preferably at least 1% and at most 50%, and particularly preferably at least 3% and at most 40%.

Tensile strength and elongation at break can depend on the direction in which the sample for the measurement is taken from the filter material. Said features of the filter material are respectively complied with when the tensile strength or the elongation at break in at least one direction lies in the preferred or particularly preferred intervals.

Segments for smoking articles can be manufactured from the filter material of the invention using processes that are known in the art. These processes, for example, comprise crimping or folding the filter material, forming a continuous rod from the crimped or folded filter material, wrapping the continuous rod with a wrapping material and cutting the wrapped rod into individual rods of a defined length. In many cases, the length of such a rod is an integer multiple of the length of the segment that is then to be used in the smoking article according to the invention, and thus the rods are then cut into segments of the desired length before or during manufacture of the smoking article.

The segment according to the invention for smoking articles comprises the filter material according to the invention and a wrapping material.

In a preferred embodiment of the segment according to the invention, the segment is cylindrical with a diameter of at least 3 mm and at most 10 mm, particularly preferably at least 4 mm and at most 9 mm, and more particularly preferably at least 5 mm and at most 8 mm. These diameters are beneficial for the use of the segments according to the invention in smoking articles.

In a preferred embodiment of the segment according to the invention, the segment has a length of at least 4 mm and at most 40 mm, particularly preferably at least 6 mm and at most 35 mm and in particular at least 10 mm and at most 28 mm.

The draw resistance of the segment determines, inter alia, which pressure difference the smoker has to apply during consumption of the smoking article in order to draw a certain volumetric flow through the smoking article, and it thus essentially influences the acceptance of the smoking article by the smoker. The draw resistance of the segment can be measured in accordance with ISO 6565:2015 and is given in mm water gauge (mmWG). To a very good approximation, the draw resistance of the segment is proportional to the length of the segment, so that the measurement of the draw resistance can also be carried out on rods that differ from the segment only in their length. The draw resistance of the segment can be easily calculated therefrom.

The draw resistance of the segment per unit length of segment is preferably at least 1 mmWG/mm and at most 12 mmWG/mm and particularly preferably at least 2 mmWG/mm and at most 10 mmWG/mm.

The wrapping material of the segment according to the invention is preferably a paper or a film.

The wrapping material of the segment according to the invention preferably has a basis weight of at least 20 g/m$^2$ and at most 150 g/m$^2$, particularly preferably at least 30 g/m$^2$ and at most 130 g/m$^2$. A wrapping material with this preferred or particularly preferred basis weight provides the segment according to the invention wrapped thereby with a particularly advantageous hardness. This means that the smoker cannot accidentally compress the segment located inside the smoking article.

Smoking articles according to the invention can be manufactured from the segment according to the invention using processes that are known in the art.

The smoking article according to the invention comprises a segment that contains an aerosol-forming material and a segment that comprises the filter material according to the invention and a wrapping material.

As the cut face of the segment according to the invention is optically very similar to that of a segment from cellulose acetate, in a preferred embodiment, the segment of the smoking article located next to the mouth end is a segment according to the invention.

In a preferred embodiment, the smoking article is a filter cigarette, and the aerosol-generating material comprises tobacco.

In a preferred embodiment, the smoking article is a smoking article in which, during the intended use, the aerosol-forming material is only heated but not burned, and the aerosol-generating material comprises tobacco, reconstituted tobacco, nicotine, glycerol, propylene glycol or mixtures thereof.

The transparency caused by the special structure of the filter material allows for further advantages. Some smoking articles are constructed so that the smoker can see the inside the smoking article. For such smoking articles, the wrapping materials are partially transparent, or holes are provided that allow a direct view of the filter material. However, because of their low transparency, it is not possible to see further into filters which are known in the art. If the filter material according to the invention has a transparency of more than 50% it is possible, for example, to recognize breakable capsules filled with flavors that are located in the filter. In a particularly preferred embodiment of the smoking article, the smoking article thus comprises a segment that contains an aerosol-forming material and a segment that comprises the filter material of the invention and a wrapping material, wherein the wrapping material is at least partially transparent or has holes and the filter material has a transparency, measured in accordance with DIN 53147:1993-01, of at least 50%.

The inventors have surprisingly found that the filter material is also suitable for oral nicotine delivery products. The inventors have found that the filter material according to the invention has good biodegradability due to its composition and due to the special structure, which is characterized by the transparency, it also has good permeability of the substances released from the nicotine-containing material of the oral nicotine delivery product during use, so that it is particularly suitable for nicotine delivery products.

An oral nicotine delivery product according to the invention thus comprises a pouch that is formed by the filter material according to the invention and which contains a nicotine-containing material. Preferably, the filter material has a transparency, measured in accordance with DIN 53147:1993-01, of at least 50% and at most 70%.

The nicotine-containing material can preferably be tobacco.

The filter material according to the invention can be manufactured according to the following process according to the invention, which comprises the steps A to D.

A—providing a fiber web comprising cellulose fibers,

B—hydroentangling the fiber web by at least one water jet directed onto the fiber web in order to produce a hydroentangled fiber web, C—generating a structure in the hydroentangled fiber web, D—drying the hydroentangled fiber web, wherein the amount of cellulose fibers in step A is selected such that after drying in step D, the filter material contains at least 50% and at most 100% cellulose fibers with respect to the mass of the filter material, and after drying in step D, the filter material has a basis weight of at least 25 g/m$^2$ and at most 60 g/m$^2$, and after drying in step D, the filter material has a structure that is characterized in that it provides a transparency to the filter material, measured in accordance with DIN 53147:1993-01, of at least 45% and at most 70%, and the generation of a structure in step C is carried out by directing at least one water jet onto the fiber web while the fiber web is supported by a surface that has a plurality of prominences.

The at least one water jet directed onto the fiber web in step C causes a redistribution of fibers so that they arrange themselves around the prominences and are displaced by the prominences. The prominences thus generate holes or thin spots, depending on the pressure of the water jets and the amount of fibers initially present in the region of the prominence. The structure provides the filter material with the initially described characteristically increased transparency. In general, however, the shape of the prominences is only imprecisely transferred to the fiber web so that, even if all the prominences had the same shape, the holes or thin spots in the fiber web and in the filter material are irregular with respect to their shape and size. The increase in transparency, however, can be reliably proved. Thinner spots and in particular holes can basically also be produced by embossing or by die-cutting, but in that regard, the fibers are compressed or cut and not arranged differently. By the process according to the invention described herein, however, the fibers are arranged around the holes or thin spots and thus result in a network-like structure. This network-like structure enables the hardness of the segment manufactured therefrom to be higher and the draw resistance to be lower for a given material than for a filter material with an approximately homogeneous surface, or a filter material that is produced by embossing or die-cutting.

The filter material manufactured according to this process should be suitable for use in nicotine delivery products. This means that it can in particular have all the features, individually or in combination, which were described above in connection with the filter material and are defined in the claims directed to the filter material.

In a preferred embodiment of the process according to the invention, the provision of a fiber web in step A comprises spinning a plurality of cellulose fibers, wherein the cellulose fibers are formed by filaments of regenerated cellulose and wherein, after drying in step D, at least 90% of the mass of the filter material are formed by the filaments of regenerated cellulose. In a particularly preferred embodiment of this process, the filaments of regenerated cellulose are LYOCELL®.

In another preferred embodiment of the process according to the invention, the provision of a fiber web in step A comprises the following steps A1 to A4.

A1—producing an aqueous suspension comprising cellulose fibers,

A2—applying the suspension from step A to a running wire,

A3—de-watering the suspension through the running wire in order to form a fiber web, A4—transferring the fiber web from step A3 onto a support wire.

In a preferred embodiment of the process according to the invention, the aqueous suspension in step A1 has a solid content of at most 3.0%, particularly preferably at most 1.0%, more particularly preferably at most 0.2% and in particular at most 0.05%. The particularly low solid content of the suspension enables a fiber web with a low density to be formed in step A3, which is beneficial for the filtration efficiency of a segment manufactured therefrom.

In a preferred embodiment of the process according to the invention, the running wire in steps A2 and A3 is inclined upwards in the running direction of the fiber web by an angle of at least 3° and at most 400 with respect to the horizontal, particularly preferably by an angle of at least 5° and at most 30° and more particularly preferably by an angle of at least 15° and at most 25°.

In a preferred embodiment, the process comprises a step in which a pressure difference is generated between the two sides of the running wire, in order to support the de-watering of the suspension in step A3, wherein particularly preferably, the pressure difference is generated by vacuum boxes or suitably shaped fins.

In a preferred embodiment of the process according to the invention, a plurality of water jets is used to carry out the hydroentangling in step B, wherein the water jets are arranged in at least one row transverse to the running direction of the fiber web.

In a preferred embodiment of the process according to the invention, the hydroentangling in step B is carried out by at least two water jets directed onto the fiber web, wherein particularly preferably, the at least two water jets act on different sides of the fiber web.

In a preferred embodiment of the process according to the invention, the fiber web in step C is supported by a cylinder on the surface of which the plurality of prominences is located.

Preferably, the area of each prominence, projected onto the surface that supports the fiber web in step C is at least 0.1 $mm^2$ and at most 15 $mm^2$, particularly preferably at least 0.25 $mm^2$ and at most 10 $mm^2$.

In a preferred embodiment of the process according to the invention, the process comprises a further step in which one or more additives are applied to the fiber web. The additives are preferably selected from the group consisting of alkyl ketene dimers (AKD), alkenyl succinic acid anhydrides (ASA), fatty acids, starch, starch derivatives, carboxy methyl cellulose, alginates, wet strength agents, substances for the adjustment of the pH such as, for example, organic or inorganic acids or bases and mixtures thereof, or the additives are burn additives which are selected from the group consisting of citrates, malates, tartrates, acetates, nitrates, succinates, fumarates, gluconates, glycolates, lactates, oxalates, salicylates, α-hydroxy caprylates, phosphates, polyphosphates, chlorides and hydrogen carbonates and mixtures thereof.

In a preferred embodiment of the process according to the invention, the application of the one additive or of the additives is carried out between the steps C and D of the process according to the invention. In another preferred embodiment of the process according to the invention, the application of the one additive or of the additives is carried out after step D, followed by a further step for drying the fiber web.

In a preferred embodiment of the process according to the invention, the drying in step D is at least partially carried out by contact with hot air, by infra-red radiation or by microwave radiation. Drying by direct contact with a heated surface is also possible, but less preferred, because then, the thickness of the hydroentangled filter material could be decreased.

In a further process, the filter material according to the invention can also be manufactured by the steps A, B and D. Here, step C is dispensed with, so that the process is not according to the invention. In step B, a high pressure is selected for some of the waterjets, so that the water jets generate holes or thin spots in the fiber web supported by the support wire. For a filter material manufactured by this process, the irregularities can be much less spatially extended, so that the filter material is then only according to the invention if the machine settings, for example the pressure of the water jets, are selected such that the transparency of the filter material is at least 45% and at most 70%.

DESCRIPTION OF THE PREFERRED EMBODIMENTS, AND SOME COMPARATIVE EXAMPLES

Some preferred embodiments of the filter material, the process for manufacturing the filter material, the segment of the smoking article and the smoking article will be described below. Furthermore, Comparative Examples not according to the invention are described.

Figure 1:
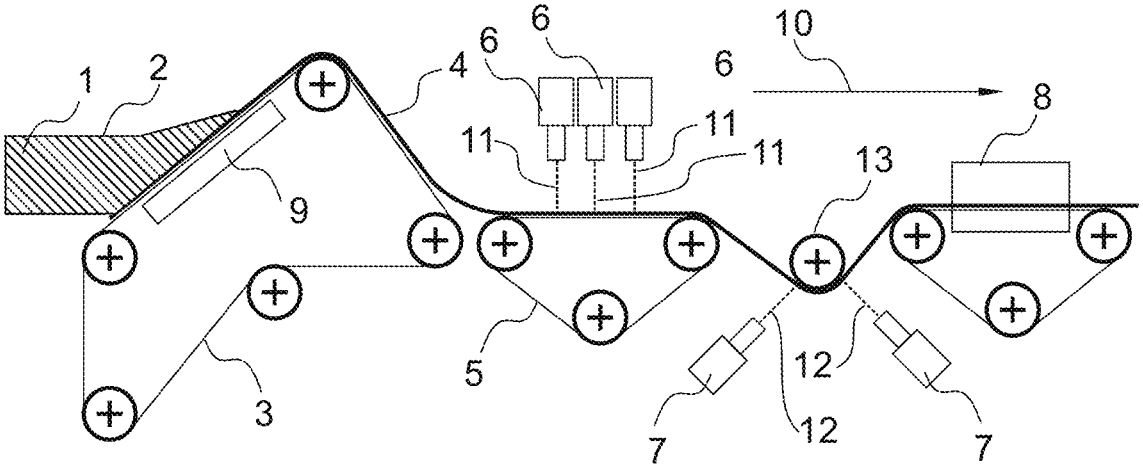
FIG. 1 shows an arrangement by means of which the process according to the invention for the manufacture of the hydroentangled filter material can be carried out.

For the manufacture of the filter material, the arrangement shown in FIG. 1 was used.

A suspension 1 of pulp fibers and fibers from regenerated cellulose was provided in a storage tank 2, step A1, and from there pumped onto a running wire 3, inclined upwards with respect to the horizontal, step A2, and de-watered by vacuum boxes 9, step A3, so that a fiber web 4 was formed on the wire, the general direction of movement of which is indicated by the arrow 10. The fiber web 4 was removed from the wire 3 and transferred to a support wire 5 which was also running, step A4. There, water jets 11 arranged in several rows transverse to the running direction of the fiber web 4 were directed from devices 6 onto the fiber web 4 to entangle the fibers and to consolidate the fiber web 4 to a nonwoven, step B. In a further step, waterjets 12 were also directed onto the other side of the fiber web 4 by additional devices 7, wherein the fiber web 4 was supported by a cylindrical reel 13, on the surface of which a plurality of prominences had been provided, step C. Next, the still-moist nonwoven ran through a drying device 8 and was dried there, step D, in order to obtain the filter material.

Exemplary Example 1

In order to manufacture the hydroentangled filter material, a mixture of pulp fibers from coniferous wood and LYOCELL® fibers was used, wherein the amount of fibers was selected such that the finished filter material consisted of 65% pulp fibers and 35% LYOCELL® fibers. The finished filter material had a basis weight of 55 g/m$^2$ and a thickness of 330 μm.

In step C of the manufacturing process, a row of water jets, 12 in FIG. 1, was directed onto the fiber web 4, while the fiber web 4 was supported by a reel, 13 in FIG. 1. The reel had prismatic prominences arranged next to each other (not shown in FIG. 1) with a square base of 1 mm×1 mm. The prominences were arranged in rows, wherein a distance of 1 mm was provided between neighboring rows and between the prominences in each row.

Figure 2:
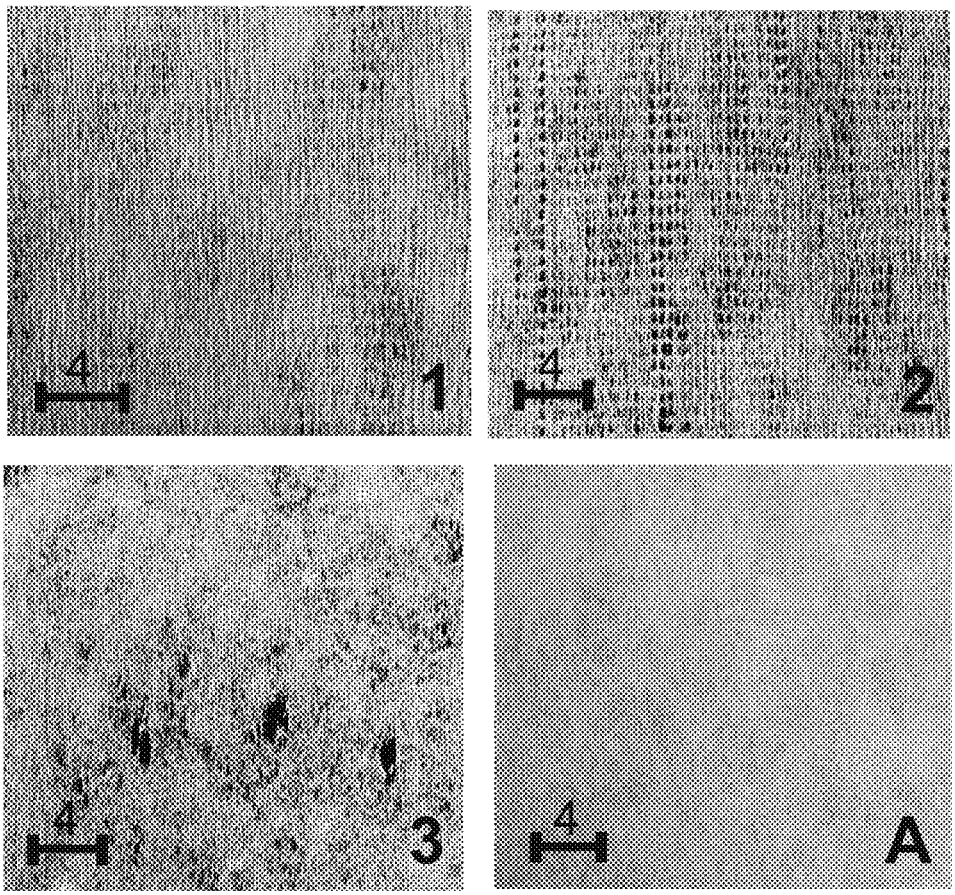
FIG. 2 shows, by way of example, filter materials according to the invention and not according to the invention.

The prominences and the action of the water jets generated thin spots but also holes in the filter material, which provided the filter material with an overall irregular structure. The transparency of the filter material was measured on several randomly selected positions in accordance with DIN 53147:1993-01 and a value of 49.1% at a standard deviation of 0.76% (absolute) was obtained. FIG. 2 shows the filter material of Exemplary Example 1, designated by 1, wherein the line 4 is about 1 cm long.

Exemplary Example 2

In order to manufacture the hydroentangled filter material, a mixture of pulp fibers from coniferous wood and viscose fibers was used, wherein the amount of fibers was selected such that the finished filter material consisted of 80% pulp fibers and 20% viscose fibers. The finished filter material had a basis weight of 50 g/m$^2$ and a thickness of 290 μm.

In step C of the manufacturing process, a row of water jets, 12 in FIG. 1, was directed onto the fiber web 4, while the fiber web 4 was supported by a reel, 13 in FIG. 1. The reel, 13 in FIG. 1, was configured as in Exemplary Example 1, but the pressure of the water jets, 12 in FIG. 1, was selected to be higher.

The prominences and the action of the water jets generated thin spots, but because of the higher pressure, more holes were generated than in the filter material of Exemplary Example 1. The transparency of the filter material was measured on several randomly selected positions in accordance with DIN 53147:1993-01 and a value of 55.7% with a standard deviation of 1.62% (absolute) was obtained. FIG. 2 shows the filter material of Exemplary Example 2, designated by 2, wherein the line 4 is about 1 cm long.

Exemplary Example 3

In order to manufacture the hydroentangled filter material, the same mixture of fibers was used as in Exemplary Example 2. The finished filter material had a basis weight of 35 g/m$^2$ and a thickness of 200 μm.

Differing from the process according to the invention, step C was dispensed with and the pressure of the water jets in step B was selected to be so high that thin spots and holes in the filter material were generated in a very irregular arrangement.

The transparency of the filter material was measured on several randomly selected positions in accordance with DIN 53147:1993-01 and a value of 52.3% with a standard deviation of 2.47% (absolute) was obtained. FIG. 2. shows the filter material of Exemplary Example 3, designated by 3, wherein the line 4 is about 1 cm long.

Comparative Example A

In order to manufacture a filter material that was not according to the invention, the same mixture of fibers was used as in Exemplary Example 1. However, the basis weight was selected to be particularly low and was only 25.8 g/m$^2$ in the finished filter material.

The filter material was manufactured according to steps A, B and D of the process according to the invention, but the generation of a structure in step C was dispensed with. The surface of the filter material was apparently much more homogeneous than that of Exemplary Examples 1 to 3.

The transparency of the filter material according to the invention was measured on several randomly selected positions in accordance with DIN 53147:1993-01 and a value of 38.2% with a standard deviation of 0.53% (absolute) was obtained. FIG. 2 shows the filter material of the Comparative Example that was not according to the invention, designated by A, wherein the line 4 is about 1 cm long.

Filter rods wrapped with paper were manufactured with a length of 100 mm and a diameter of 7.85 mm from each filter material of the Exemplary Examples 1 to 3 and of the Comparative Example. The width of the web of filter material and the machine settings during filter manufacture where selected such that for each filter rod, a similar draw resistance of 440±15 mmWG was obtained. Segments with a length of 20 mm were cut from the filter rod and American blend cigarettes with a length of 83 mm without filter ventilation were manufactured therefrom. The mean weight of the cigarettes was 932.7 mg. The cigarettes were smoked in accordance with the method specified in ISO 3308:2012 and the amount of nicotine-free dry particulate matter per cigarette was determined. The filter segments of the cigarettes were removed and the amount of nicotine-free dry particulate matter contained in each filter segment was also determined and the filtration efficiency in percent was calculated therefrom, wherein the filtration efficiency expresses which proportion of the nicotine-free dry particulate matter flowing into the filter segment is retained in the filter. Thus, in addition to the properties of the filter material, the filtration efficiency also depends on the length and the diameter of the filter segment.

The hardness of the filter rods was measured with a DD60A measuring instrument from Borgwaldt KC. Here, filter rods are exposed to a load by a test body with a defined force for a defined time and the deformation is measured and expressed as a percentage with respect to the undeformed state.

The draw resistance (PD) of the filter rod, the filtration efficiency (FE) for nicotine-free dry particulate matter and the hardness (HD) of the filter segment are shown in Table 1. In addition, the transparency (TR) of the filter material in accordance with DIN 53147:1993-01 is shown in Table 1. In addition to the Exemplary Examples 1-3 and the Comparative Example A, the data for a filter produced from cellulose acetate is shown as Comparative Example B. For the Comparative Example B, no transparency could be measured as the filter material was not in the form of a fiber web.

TABLE 1

| Example | TR % | PD mmWG | FE % | HD % |
|---|---|---|---|---|
| 1 | 49.1 | 443 | 67.3 | 78 |
| 2 | 55.7 | 445 | 65.0 | 80 |
| 3 | 52.3 | 429 | 62.8 | 77 |
| A | 38.2 | 438 | 75.3 | 81 |
| B | | 440 | 54.1 | 84 |

It can be seen from Table 1 that at a comparable draw resistance, the filtration efficiency of the segments from Exemplary Examples 1 to 3 is significantly closer to the filtration efficiency of a filter from cellulose acetate, Comparative Example B, than the segment of Comparative Example A, not according to the invention. Apparently, despite the similar draw resistance, the network-like structure of Exemplary Examples 1 to 3 allows for a better flow of the aerosol through the segment, so that less nicotine-free dry particulate matter is filtered out of the aerosol. It can also be seen that this reduction of the filtration efficiency is accompanied by an increase in transparency, so that the transparency is in fact a suitable parameter for characterizing the irregularities of the filter material and to establish a connection with the filtration efficiency.

The hardness of the segments from the Exemplary Examples 1 to 3 according to the invention is slightly lower than that of the Comparative Examples A and B. This is of lesser importance because such a small difference in hardness can also be compensated for by selecting a stiffer wrapping material for the segment.

A subjective comparison of the optical appearance of the filter cross-section of the cigarettes visible at the mouth end from Exemplary Examples 1 to 3 with the filter produced from cellulose acetate, Comparative Example B, shows that they differ only slightly and in this respect are in any case significantly more similar to Comparative Example B than conventional paper filters.

Thus, it has been shown that segments can be manufactured from the filter material according to the invention, the properties of which with respect to draw resistance, filtration efficiency, hardness and optical appearance, are overall closer to filters produced from cellulose acetate than filter materials produced from paper or hydroentangled filter materials not according to the invention. The biodegradability of the filter materials according to the invention is, however, significantly better than those produced from cellulose acetate.

An oral nicotine delivery product in the form of a pouch filled with prepared tobacco was manufactured from the filter material according to the invention of Exemplary Example 2, wherein with respect to the use, no differences with respect to conventional oral nicotine delivery products were found. The pouch, however, has better biodegradability than conventional pouches.

The invention claimed is:

1. A filter material for manufacturing a nicotine delivery product, wherein the filter material is hydroentangled and contains at least 50% and at most 100% cellulose fibers, each with respect to the mass of the filter material, wherein the filter material has a basis weight of at least 25 g/m$^2$ and at most 60 g/m$^2$, and wherein the filter material has a structure that is characterized in that it provides the filter material with a transparency which, measured in accordance with DIN 53147:1993-01, is at least 45% and at most 70%.

2. The filter material according to claim 1, in which the proportion of cellulose fibers in the filter material is at least 70% and at most 95%, each with respect to the mass of the filter material.

3. The filter material according to claim 1, in which the cellulose fibers are formed by pulp fibers, fibers from regenerated cellulose or mixtures thereof.

4. The filter material according to claim 3, in which the proportion of fibers produced from regenerated cellulose is at least 15% and at most 40% with respect to the mass of the filter material.

5. The filter material according to claim 1, the basis weight of which, in accordance with ISO 536:2012 is at least 28 g/m$^2$ and at most 55 g/m$^2$.

6. The filter material according to claim 1, the transparency of which, measured in accordance with DIN 53147:1993-01 is at least 50% and at most 66%.

7. The filter material according to claim 1, in which said structure comprises a plurality of holes in the filter material, wherein at least 90% of the holes have an area of less than 10 mm$^2$.

8. The filter material according to claim 1, which further contains one or more additional components selected from the group consisting of alkyl ketene dimers (AKD), alkenyl succinic acid anhydrides (ASA), fatty acids, starch, starch derivatives, carboxy methyl cellulose, alginates, wet strength agents, organic or inorganic acids or bases, or burn additives selected from the group consisting of citrates, malates, tartrates, acetates, nitrates, succinates, fumarates, gluconates, glycolates, lactates, oxalates, salicylates, α-hydroxy caprylates, phosphates, polyphosphates, chlorides and hydrogen carbonates, and mixtures thereof.

9. The filter material according to claim 1, which further contains one or more substances selected from the group consisting of triacetin, propylene glycol, sorbitol, glycerol, polyethylene glycol, polypropylene glycol, polyvinyl alcohol and triethyl citrate.

10. The filter material according to claim 1, the thickness of which, measured in accordance with ISO 534:2011 is at least 70 μm and at most 1000 μm.

11. The filter material according to claim 1, the tensile strength with respect to width of which, measured in accordance with ISO 1924-2:2008 in at least one direction, is at least 0.05 kN/m and at most 5 kN/m.

12. The filter material according to claim 1, the elongation at break of which, measured in accordance with ISO 1924-2:2008 in at least one direction, is at least 3% and at most 40%.

13. A segment for a nicotine delivery product, wherein the nicotine delivery product is a smoking article, comprising a filter material according to claim 1 and a wrapping material, which wraps the filter material.

14. The segment according to claim 13, wherein the segment is in the shape of a cylinder with a circular base area, wherein the circular base area has a diameter of at least 5 mm and at most 8 mm.

15. The segment according to claim 13, which has a length of at least 4 mm and at most 40 mm.

16. The segment according to claim 13, the draw resistance per length of the segment of which, measured in accordance with ISO 6565:2015, is at least 1 mmWG/mm and at most 12 mmWG/mm.

17. The segment according to claim 13, in which the wrapping material is a paper or a film.

18. The segment according to claim 13, in which the wrapping material has a basis weight of at least 20 g/m$^2$ and at most 150 g/m$^2$.

19. A smoking article, comprising a segment, which contains an aerosol-forming material, and a segment according to claim 13.

20. The smoking article according to claim 19, in which the segment according to claim 13 is a segment located next to the mouth end of the smoking article.

21. The smoking article according to claim 19, in which the smoking article is a filter cigarette and the aerosol-forming material is tobacco.

22. The smoking article according to claim 19, during the intended use of which the aerosol-forming material is only heated but not burned, and the aerosol-forming material comprises tobacco, reconstituted tobacco, nicotine, glycerol, propylene glycol or mixtures of two or more of these components.

23. The smoking article according to claim 19, in which the wrapping material of said segment according to claim 13 is at least partially transparent or has holes and the filter material has a transparency, measured in accordance with DIN 53147:1993-01, of at least 50%.

24. An oral nicotine delivery product comprising a pouch which is formed by a filter material according to claim 1 and contains a nicotine-containing material, wherein the filter material has said transparency, measured in accordance with DIN 53147:1993-01, of at least 50% and at most 70%.

25. A process for the manufacture of a filter material, which comprises the steps A to D:

A—providing a fiber web comprising cellulose fibers,

B—hydroentangling the fiber web by at least one water jet directed onto the fiber web in order to manufacture a hydroentangled fiber web, C—generating a structure in the hydroentangled fiber web, D—drying the hydroentangled fiber web, wherein the amount of cellulose fibers in step A is selected such that after drying in step D, the filter material contains at least 50% and at most 100% cellulose fibers with respect to the mass of the filter material, and after drying in step D, the filter material has a basis weight of at least 25 g/m$^2$ and at most 60 g/m$^2$, and wherein after drying in step D, said structure is characterized in that it provides the filter material with a transparency, measured in accordance with DIN 53147: 1993-01, of at least 45% and at most 70%, and the generation of a structure in step C is carried out by directing at least one water jet onto the fiber web while the fiber web is supported by a surface that has a plurality of prominences.

26. The process according to claim 25, wherein step A comprises the steps A1 to A4:

A1—manufacturing an aqueous suspension comprising cellulose fibers,

A2—applying the suspension from step A to a running wire,

A3—de-watering the suspension through the running wire in order to form a fiber web, and A4—transferring the fiber web from step A3 to a support wire.

27. The process according to claim 26, in which the aqueous suspension in step A1 has a solid content of at most 0.2%.

28. The process according to claim 25, in which a plurality of water jets is used in order to carry out the hydroentangling in step B, wherein the water jets are arranged in at least one row transverse to the running direction of the fiber web.

29. The process according to claim 25, in which the hydroentangling in step B is carried out by at least two water jets directed onto the fiber web, wherein the at least two water jets act from different sides of the fiber web.

30. The process according to claim 25, in which the fiber web in step C is supported by a cylinder, on the surface of which a plurality of prominences is located.

31. The process according to claim 25, in which the area of each prominence, projected onto the surface that supports the fiber web in step C, is at least 0.1 mm$^2$ and at most 15 mm$^2$.

32. The process according to claim 25, in which the drying in step D is at least partially carried out by contact with hot air, by infra-red radiation or by microwave radiation.

33. The process according to claim 25, in which after drying in step D, the filter material is a filter material used for manufacturing a nicotine delivery product according to claim 1.

* * * * *